US008247721B2

(12) United States Patent
Sanford

(10) Patent No.: US 8,247,721 B2
(45) Date of Patent: Aug. 21, 2012

(54) HOLD SWITCH

(75) Inventor: Emery Sanford, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 767 days.

(21) Appl. No.: 12/180,315

(22) Filed: Jul. 25, 2008

(65) Prior Publication Data

US 2010/0018844 A1 Jan. 28, 2010

(51) Int. Cl.
*H01H 9/16* (2006.01)

(52) U.S. Cl. ..... 200/308; 200/315

(58) Field of Classification Search ..... 200/308, 200/309, 313, 315
See application file for complete search history.

(56) References Cited

U.S. PATENT DOCUMENTS 4,833,280 A * 5/1989 Bingo et al. ..... 200/16 D
4,871,893 A * 10/1989 Slovak et al. ..... 200/16 R
6,380,501 B1 * 4/2002 Figueroa et al. ..... 200/308

* cited by examiner

*Primary Examiner* — Amy Cohen Johnson
*Assistant Examiner* — Marina Fishman
(74) *Attorney, Agent, or Firm* — Kramer Levin Naftalis & Frankel LLP

(57) ABSTRACT

This invention is directed to a switch for use in an electronic device. As the user actuates the switch, different labels may be visible to indicate to the user the current state of the switch. To allow the switch to be positioned adjacent to an edge of the device, the switch may include only a single label that moves with the switch. For example, the switch may include a label positioned adjacent to a nub that the user may operate. The label may be sized such that only the label is visible when the switch is in a first position. The electronic device may also include a second label that is fixed to a non-moving portion of the electronic device. When the user moves the switch, the switch may move away from and uncover the second label while hiding the label that is included in the switch.

12 Claims, 3 Drawing Sheets

HOLD SWITCH

BACKGROUND OF THE INVENTION

This invention is directed to an electronic device switch for use in a small form factor electronic device.

Electronic devices may have several types of input mechanisms for a user to provide instructions or commands to the electronic device. In some embodiments, the input mechanism may include a switch that may be moved in different positions. The electronic device may provide labels associated with each of the switch positions. The labels may provide any suitable information to a user, including for example a value or instruction associated with each switch position. The labels may be sequentially displayed such that only the label associated with a particular switch position is displayed when the switch is in the corresponding position.

If the switch is a linear switch, the switch may include labels extending from each side of the switch. As the user then moves the switch within a slot, the label on each side of the switch may be displayed within the slot (e.g., such that as the switch is placed against one end of the slot, the label adjacent to the slot may be visible to the user.

To provide a visible label for each position of the switch, the switch may include a label portion extending from each side of the switch. The existence of a label on both sides of the switch, however, may limit how close the switch may be placed to an edge of the electronic device. In particular, because the label that is displayed when the switch is away from an edge of the electronic device must be hidden from view when the switch is adjacent to the same edge, the switch must be placed at a distance at least equal to the length of the label from the edge. If the switch is retained using an adhesive coupling a cap to the electronic device, the electronic device may further require additional distance between the switch and the edge of the device to allow for adhesive between the label and the edge.

SUMMARY OF THE INVENTION

A switch assembly having a single label incorporated in the switch is provided.

The switch may include a frame having at least one tab operative to engage an actuator of the electronic switch (e.g., an actuator of a switch coupled to a circuit board). The frame may include a nub extending from a top surface of the frame. The nub may extend out of the electronic device and be actuated by a user. In particular, a user may move the nub between a first position and a second position. The frame may include a label placed adjacent to the nub, and between the nub and the at least one tab. When the frame is in a first position, the label of the frame may be visible to a user of the electronic device, and when the frame is in a second position, a label fixed to the device and positioned underneath the frame may be visible.

An electronic device may be provided. The exterior of the electronic device may be defined by a housing. An end cap may be positioned over an end of the housing to retain electronic device components within the housing. A first label may be fixed to a surface of the end cap such that the first label faces out of the housing. A movable switch may be placed on the end cap. The switch may include a nub and a second label placed adjacent to the nub. A cosmetic cap may be placed over the switch and over the end cap, such that the nub of the switch may extend through a slot in the cosmetic cap. The cosmetic cap may be coupled to the end cap, for example using an adhesive, such that the switch may slide in between the cosmetic cap and the end cap to selectively make visible the first and the second labels through the slot in the cosmetic cap.

BRIEF DESCRIPTION OF THE DRAWINGS

The above and other features of the present invention, its nature and various advantages will be more apparent upon consideration of the following detailed description, taken in conjunction with the accompanying drawings, and in which.

DETAILED DESCRIPTION

An electronic device having a curved outer housing may be provided. The electronic device may include one or more input mechanisms by which a user may control the electronic device, including for example one or more switches. To reduce the size of the electronic device, or for cosmetic or industrial design reasons, it may be desirable to provide a switch that may be actuated by a user in a position as close to a curved edge of the housing as possible. If the switch includes two labels visible to the user when the switch is moved in different positions, the space needed by the labels may prevent the switch from being placed very close to the electronic device edge.

To allow the switch to be placed closer to the electronic device edge, the label that would be positioned between the electronic device edge and the switch may be removed from the switch. To ensure that a user would still see the label when the switch moves away from the electronic device edge, however, the label may be positioned in a different vertical plane than the switch. In particular, the label may be positioned below the switch such that when the switch is moved towards the electronic device edge, the switch may hide the label from view, but when the switch moves away from the electronic device edge, the label may be visible. For example, the label may be coupled to an electronic device component, such as an end cap over which the switch may move.

Figure 1:
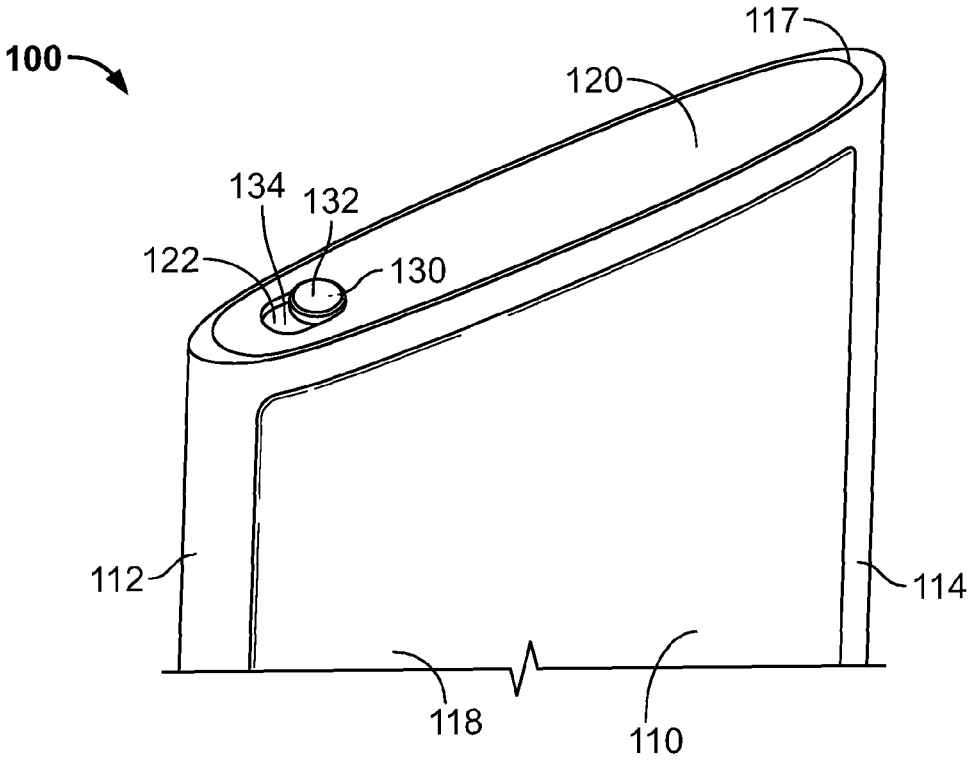
FIG. 1 is schematic view of an illustrative electronic device in accordance with one embodiment of the invention.

FIG. 1 is schematic view of an illustrative electronic device in accordance with one embodiment of the invention. Electronic device 100 may include housing 110 defining at least one edge 112. Edge 112 may include any suitable edge, including for example a straight or curved edge. The curvature or shape of edge 112 may be determined based on any suitable criteria, including for example aesthetic or industrial design considerations, components placed within electronic device 100, the materials used for housing 110, or any other suitable consideration. In some embodiments, housing 110 may form a tubular structure (e.g., flattened tube defined by edges 112 and 114) having one or more open ends.

In some embodiments, housing 110 may be constructed from frame 116 into which walls 118 may be inserted or coupled (e.g., using structural or mechanical components, an adhesive, tape, or a mechanical fastener). Frame 116 may define edges 112 and 114 and give structure to housing 110 (e.g., by being manufactured from a material having sufficient structural attributes, such as a plastic, metal, or composite material), and may be finished (e.g., polished). Walls 118 may be manufactured from any suitable material (e.g., plastic, metal or a composite material) and finished to provide an aesthetically pleasing appearance.

The ends of housing 110 (and frame 116) may be closed by cosmetic cap 120 forming the top surface of housing 110. Cosmetic cap 120 may extend up to the periphery of the top surface of housing 110 (e.g., up to the edge of frame 116), or may instead be placed within groove 117 of frame 116. Cosmetic cap 120 may be manufactured from any suitable material (e.g., plastic, metal or a composite material) and finished to provide an aesthetically pleasing appearance. Cosmetic cap 120 may be sized such that cosmetic cap 120 is flush with the edges of groove 117, or flush with the edge of frame 116 to provide an aesthetically pleasing finish and to enhance the protection of components placed within housing 110 (e.g., to prevent debris from entering housing 110). Cosmetic cap 120 may be coupled to housing 110 or another component of electronic device 100 (e.g., a component placed underneath cosmetic cap 120) using any suitable approach, including for example an adhesive or tape.

The user of electronic device 100 may provide inputs using any suitable approach. In some embodiments, electronic device 100 may include switch 130 including nub 132 extending through slot 122 in cosmetic cap 120. Nub 132 may extend beyond the periphery of cosmetic cap 120 such that a user may easily touch and move switch 130. Switch 130 may include one or more labels to indicate to the user the state of the electronic device. For example, switch 130 may include label 134 that is visible through slot 122 when nub 132 is in a first position (e.g., adjacent to end 122*a*). Label 134 may be any suitable color, and include any suitable text or lettering. In some embodiments, label 134 may include an aperture through which light may be visible (e.g., an LED). In some embodiments, cosmetic cover 120 may instead or in addition include colored portions or lettering to identify the electronic device state based on the position of the switch.

Figure 2:
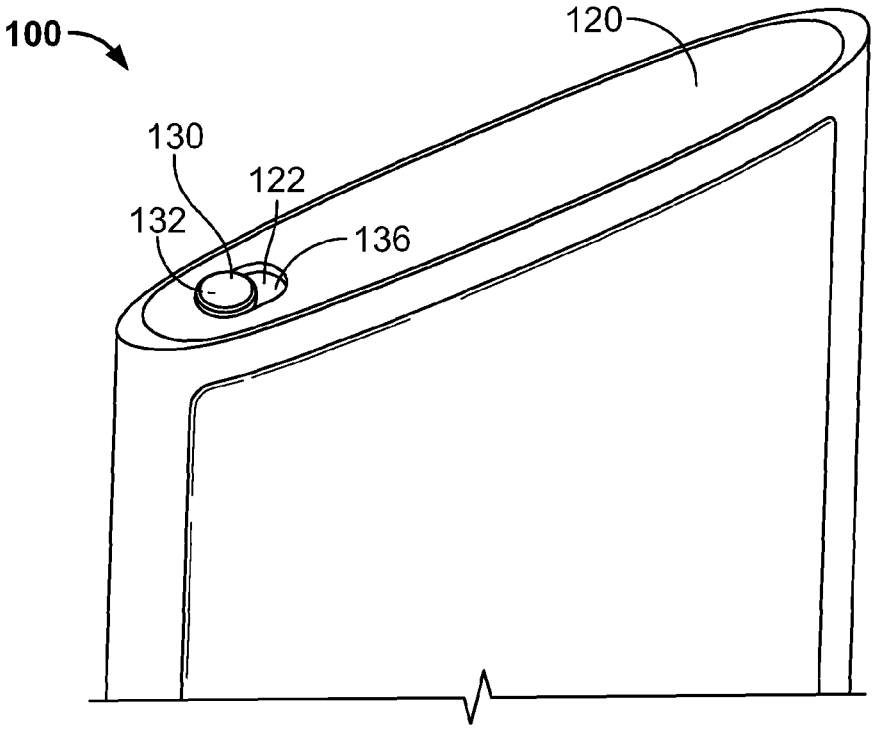
FIG. 2 is a cross-sectional view of the electronic device of FIG. 1 when the switch is positioned such that label 134 is visible in accordance with one embodiment of the invention.

FIG. 2 is a cross-sectional view of the electronic device of FIG. 1 when the switch is positioned such that label 134 is visible in accordance with one embodiment of the invention. As shown in FIG. 2, electronic device 100 may include components 102 and 104 placed within housing 110. Components 102 and 104 may be secured by end cap 140 coupled to frame 116 by fastener 142. End cap 140 may be constructed from any suitable material, including for example a metal (e.g., zinc), plastic, composite material, or any other material with sufficient strength or toughness to retain components 102 and 104 within housing 110. In some embodiments, end cap 140 may include one or more features (e.g., slots, nubs, hooks) operative to engage and retain components 102 and 104.

Label 134 may be fixed to the upper surface of end cap 140. For example, label 134 may include a painted surface of end cap 140. As another example, label 134 may be coupled to end cap 140 using an adhesive, tape, a film placed over the label, as part of a manufacturing process (e.g., co-molding or welding), or using any other suitable approach. Label 134 may be positioned such that it is visible through slot 122 of cosmetic cap 120. In particular, label 134 may be sized and positioned such that only label 134 is visible (e.g., and not end cap 140) when switch 130 moves within slot 122 (e.g., and when nub 132 is placed adjacent to end 122*a*).

Switch 130 may be movably placed on end cap 140. For example, switch 130 may be placed on end cap 140 such that switch 130 may slide in the direction of arrows 150. The range of switch 130 may be restricted by the size of slot 122 and the contacts between nub 132 and the ends of slot 122 (e.g., ends 122*a* and 122*b*). In some embodiments, switch 130 or end cap 140 may include one or more features for maintaining the alignment of switch 130 and ensuring that switch 130 may slide freely. For example, switch 130 may include one or more tabs extending over an edge or into a slot of end cap 140. As another example, switch 130 may include a slot into which a tab or post of end cap 140 may extend.

Switch 130 may be retained within electronic device 100 while allowing switch 130 to move using any suitable approach. In some embodiments, switch 130 may be retained by coupling cosmetic cap 120 to end cap 140. For example, cosmetic cap 120 may include groove 124 operative to receive switch 130 such that switch 130 may move within groove 124. As another example, end cap 140 may instead or in addition include a groove for receiving switch 130. Cosmetic cap 120 may be coupled to end cap 140 by coupling portions of cosmetic cap 120 located adjacent to groove 124 to end cap 140. In some embodiments, the portions of cosmetic cap 120 located adjacent to groove 124 may surround groove 124 and switch 130 such that switch 130 is confined to the area defined by groove 124. Cosmetic cap 120 may be coupled to end cap 140 using any suitable approach, including for example an adhesive (e.g., adhesive layer 144), tape, mechanical fastener, press fit, or any other suitable approach.

Figure 3:
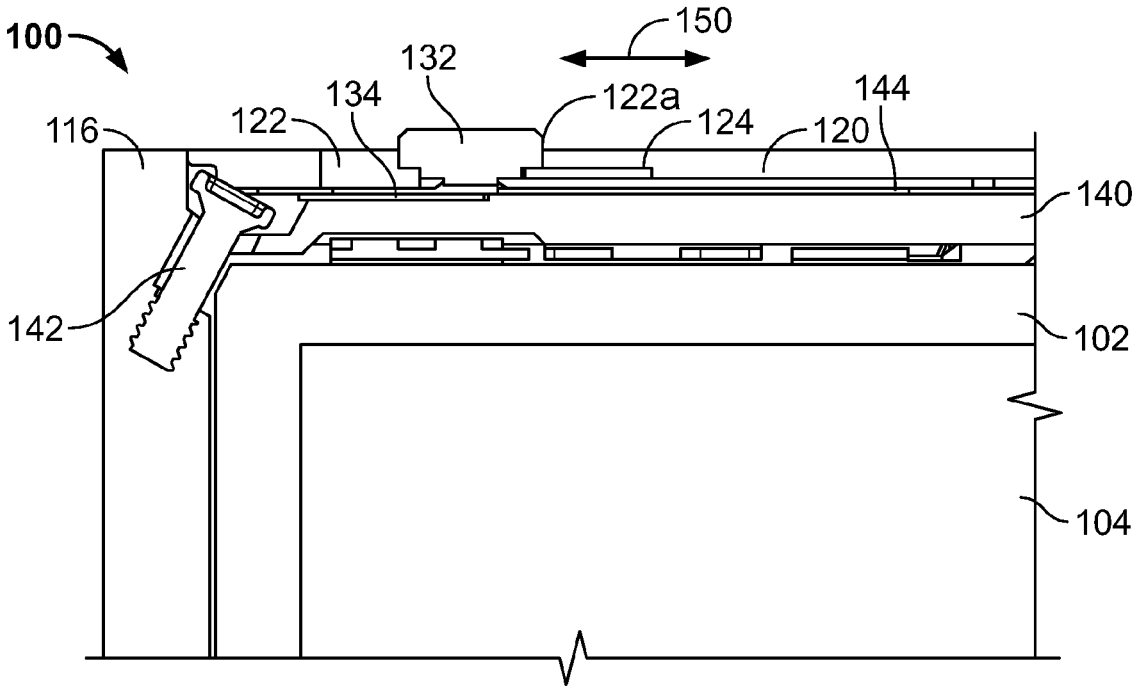
FIG. 3 is schematic view of the electronic device of FIG. 1 when the switch is moved in accordance with one embodiment of the invention.

FIG. 3 is schematic view of the electronic device of FIG. 1 when the switch is moved in accordance with one embodiment of the invention. As shown in FIG. 3, nub 132 may be moved within slot 122 such that label 134 is hidden from view and label 136 is instead visible. Label 136 may be any suitable color, and include any suitable text or lettering. In some embodiments, label 136 may include an aperture through which light may be visible (e.g., an LED). In some embodiments, cosmetic cover 120 may instead or in addition include colored portions or lettering to identify the electronic device state based on the position of the switch.

Figure 4:
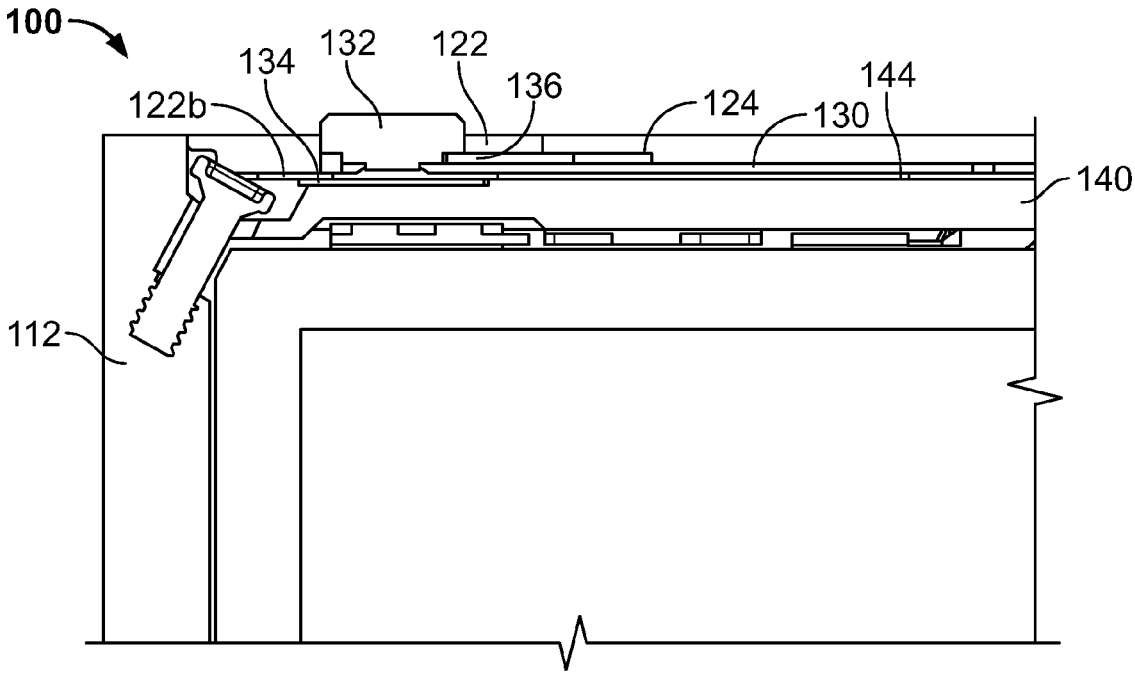
FIG. 4 is a cross-sectional view of the electronic device of FIG. 3 when the switch is positioned such that label 136 is visible in accordance with one embodiment of the invention.

FIG. 4 is a cross-sectional view of the electronic device of FIG. 3 when the switch is positioned such that label 136 is visible in accordance with one embodiment of the invention. Switch 130 may move within slot 122 such that nub 132 is placed adjacent to end 122*b* of slot 122. Unlike label 134, label 136 may incorporated in switch 130. Thus, when switch 130 moves, label 136 may move with the switch. When switch 130 is placed adjacent to end 122*a* of slot 122, label 134 located underneath switch 130 may be visible beyond the periphery of nub 132 while label 136 is hidden from view by groove 124 of cosmetic cap 120. When switch 130 is placed adjacent to end 122*b* of slot 122, nub 132 and label 136 may located over label 134 such that only nub 132 and label 136 may be visible through slot 122. By placing label 134 directly on end cap 140 rather than coupling it to switch 130, switch 130 may require less room underneath cosmetic cap 140, in particular when nub 132 is placed adjacent to end 122*b*. This may in turn allow switch 130 to be placed closer to edge 112 of housing 110. In particular, groove 124 may not need to extend past end 122*b* of slot 122 because no label may need to move past end 122*b* when nub 132 is placed adjacent to end 122*b*. The portions of adhesive layer 144 between switch 130 and edge 112 may then extend from edge 112 to end 122*b* (e.g., and not to a groove extending past end 122*b*), allowing switch 130 to be placed closer to edge 112 by at least the length of label 134. In some embodiments, the distance between nub 132 when it is adjacent to end 122*b* and the end of cosmetic cap 120 (e.g., frame 116) may be less than the length of label 134 or 136.

Figure 5:
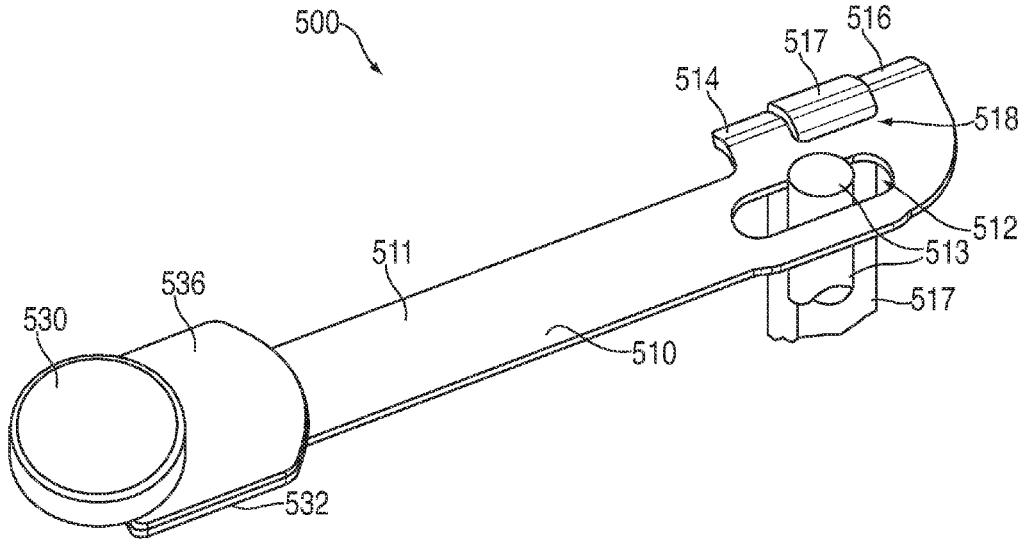
FIG. 5 is a schematic view of an illustrative switch for use with the electronic device of FIG. 1.

FIG. 5 is a schematic view of an illustrative switch for use with the electronic device of FIG. 1. Switch 500 may include frame 510. Frame 510 may be manufactured from any suitable material, including for example metal, plastic or a composite material, and using any suitable manufacturing process. For example, frame 510 may be formed by stamping (e.g., a stamped stainless steel part), forming, forging, molding, machining, or any other suitable process. Frame 510 may form a substantially elongated rectangular element having one or more features for engaging a switching element or remaining aligned within the electronic device housing. For example, frame 510 may include slot or channel 512. Channel 512 may form an elongated slot substantially following the elongated portion of frame 500. Channel 512 may be operative to receive a post from a component within the electronic device (e.g., a post 513 extending from the surface of end cap 140, FIGS. 1-4) such that the placement of the post within channel 512 may guide the travel of frame 510 as a user moves switch 500. For example, the combination of a pin within channel 512 and nub 530 extending through a slot in a cosmetic cap (e.g., slot 122 of cosmetic cap 120, FIGS. 1-4) may guide both ends of frame 510 as switch 500 moves within the electronic device. The length of channel 512, the size of the pin of the electronic device component, the length of the cosmetic cap slot, and the size of nub 530 may be selected to provide boundaries to the travel of switch 500 (e.g., nub 530 or the pin of the electronic device component may abut the channel or slot ends to prevent excess travel of switch 500).

Frame 510 may include one or more tabs, such as tabs 514 and 516, extending from the periphery of frame 510. In some embodiments, tabs 514 and 516 may extend into a different plane than frame 510. For example, in the example shown in FIG. 5, tabs 514 and 516 include curved portions causing tabs 514 and 516 to extend away from top surface 511 of frame 510 (e.g., at a 45 degree angle). Tabs 514 and 516 may be operative to engage an electronic switching component coupled to a circuit board within the electronic device. For example, the electronic device may include a switching component coupled to a circuit board (e.g., using soldering or surface mount technology) such that the switching component may be actuated in response to changing the position of an actuator extending from the switching component (e.g., actuator 517). In some embodiments, tabs 514 and 516 may be operative to enclose the actuator (e.g., the actuator may be placed in space 518 between tabs 514 and 516).

Frame 510 may include nub 530 extending from the surface of frame 510. Nub 530 may include a protrusion operative to extend from the surface of an electronic device housing that a user may actuate. Nub 530 may be manufactured using any suitable approach, including for example as part of frame 510 (e.g., using a stamping process) or separately from frame 510 (e.g., using a machining process, such as a lathe) and coupled to frame 510 (e.g., using welding). Nub 530 may be finished to enhance the cosmetic or aesthetic appeal of switch 500. For example, nub 530 may be polished, or given a texture or other finish (e.g., to enhance the user's tactile experience).

Frame 510 may include label plate 532 on which label 536 may be provided. Label plate 532 may be manufactured as part of frame 510 (e.g., stamped with frame 510), or manufactured independently and coupled to frame 510 (e.g., using welding, soldering, or an adhesive). Label plate 532 be of any suitable shape or size. For example, label plate 532 may be sized to be at least the size of a slot in a cosmetic cap of the housing (e.g., such that the entirety of label plate 532 is visible through the slot). Label 536 may be coupled to label plate 534 to provide a visual indication to the user of the state of switch 500. Label 536 may include any attribute of label 134 or 136 (FIG. 1), and may be any suitable color and include any suitable text or lettering. In some embodiments, label plate 532 and label 536 may include an aperture through which light may be visible (e.g., an LED). Label 536 may be coupled to label plate 532 using any suitable approach. For example, label 536 may include a painted surface of end cap 140. As another example, label 536 may be coupled to label plate 532 using an adhesive, tape, a film placed over the label, as part of a manufacturing process (e.g., co-molding or welding), or using any other suitable approach.

The above described embodiments of the invention are presented for the purposes of illustration and not of limitation, and the present invention is limited only by the claims which follow.

What is claimed is:

1. A switching mechanism for use in an electronic device, comprising:

a frame comprising at least one tab operative to engage an actuator;

a nub extending from a surface of the frame and operative to be actuated by a user; and a first label disposed on a surface of the frame, wherein the first label is positioned adjacent to the nub, between the nub and the at least one tab, wherein the frame is operative to be displaced to cover or uncover a second label fixed to the electronic device.

2. The switching mechanism of claim 1, wherein the frame further comprises a channel operative to receive a fixed post of the electronic device.

3. The switching mechanism of claim 2, wherein the nub is operative to be placed within a slot of the electronic device housing.

4. The switching mechanism of claim 3, wherein switching mechanism is operative to be displaced along the axes of the channel and of the slot.

5. The switching mechanism of claim 2, wherein the first label is positioned to be visible through the slot when the switching mechanism covers the second label.

6. The switching mechanism of claim 1, wherein the at least one tab extends into a plane other than the plane of the frame.

7. The switching mechanism of claim 6, further comprising two tabs, wherein the actuator is operative to be positioned between the two tabs.

8. The switching mechanism of claim 1, wherein the first label and the second label are different colors.

9. The switching mechanism of claim 1, wherein the first label is provided on a label plate of the frame.

10. The switching mechanism of claim 9, wherein the label plate of the frame comprises an aperture through which light is visible.

11. The switching mechanism of claim 1, wherein the switching mechanism is placed on an end cap of the electronic device.

12. The switching mechanism of claim 11, wherein the end cap is coupled to a cosmetic cap such that the nub extends through a slot of the cosmetic cap.

* * * * *